United States Patent [19]

Choi

[11] Patent Number: 4,757,587

[45] Date of Patent: Jul. 19, 1988

[54] PROPELLER CONSTRUCTION OF AN ELECTRIC FAN

[75] Inventor: Hyung M. Choi, Seoul, Rep. of Korea

[73] Assignee: Gold Star Co., Ltd., Seoul, Rep. of Korea

[21] Appl. No.: 927,500

[22] Filed: Nov. 6, 1986

[30] Foreign Application Priority Data

Mar. 28, 1986 [KR] Rep. of Korea ..... 2365/1986

[51] Int. Cl.[4] ..... B21K 3/00

[52] U.S. Cl. ..... 29/156.8 P; 29/156.8 B; 29/156.8 H; 416/236 A

[58] Field of Search ..... 29/156.8 P, 156.8 H, 29/156.8 B; 416/236 A

[56] References Cited

U.S. PATENT DOCUMENTS

| | | | |
|---|---|---|---|
| 10,124 | 10/1853 | Beard | 416/236 A |
| 794,010 | 7/1905 | Hayden | 416/236 A |
| 914,857 | 3/1909 | Miller | 416/236 A |
| 1,041,913 | 10/1912 | Tyson | 416/236 A |
| 1,080,964 | 12/1913 | Gays | 416/236 A |
| 2,086,307 | 7/1937 | Stewart | 416/236 A |
| 2,498,170 | 2/1950 | Meier | 416/236 A |

FOREIGN PATENT DOCUMENTS

| | | | |
|---|---|---|---|
| 850 | of 1879 | United Kingdom | 416/236 A |
| 654490 | 3/1979 | U.S.S.R. | 416/236 A |

*Primary Examiner*—Timothy V. Eley
*Assistant Examiner*—Irene Cuda
*Attorney, Agent, or Firm*—Birch, Stewart, Kolasch & Birch

[57] ABSTRACT

A fan assembly includes a propeller fixedly mounted on a shaft. The propeller has a rear side where fluid enters and a front side where fluid exits. The propeller has blades with an arcuate rib located on the front side of each blade. The arcuate rib may have curved outer surfaces at its outer ends and may be made up of portions formed about different centers of curvature.

4 Claims, 7 Drawing Sheets

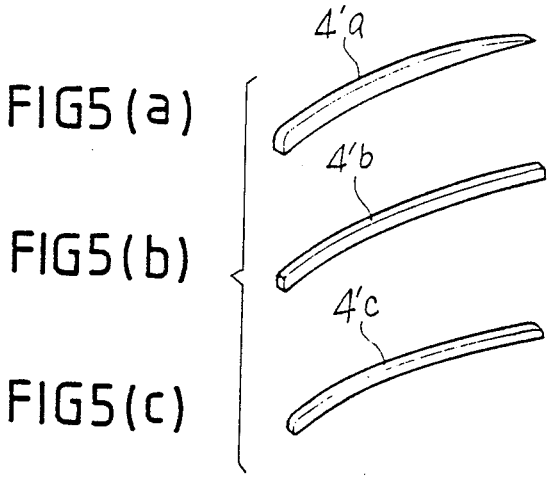
FIG6(a)
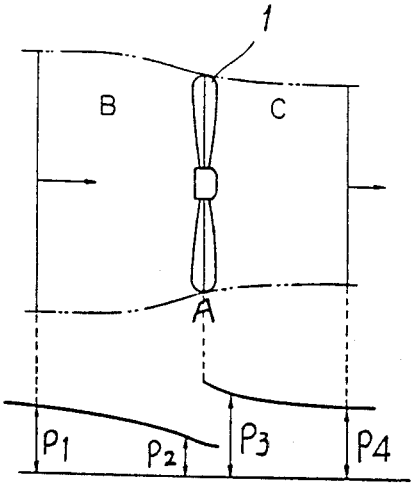
FIG6(b)
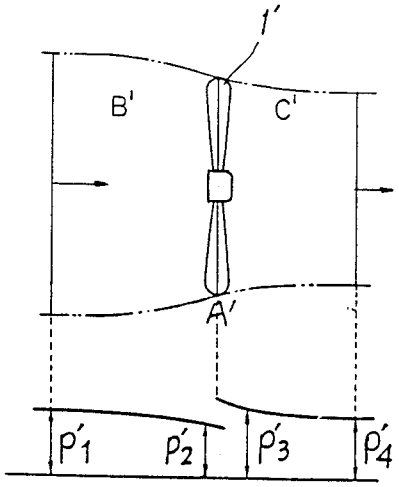

PROPELLER CONSTRUCTION OF AN ELECTRIC FAN

BACKGROUND OF THE INVENTION

The present invention relates to a propeller construction of an electric fan, and particularly to a propeller construction of an electric fan wherein each rotatable blade is provided at the outer end thereof with an arcuate rib for preventing the back-flow of fluid so that the velocity and quantity of fluid flowing out of the propeller can be increased.

In a conventional propeller construction of an electric fan, each rotatable blade extends smoothly from a center support portion thereof to form a certain involute angle. As such propeller rotates, a differential pressure is generated between the front and the back of each rotatable blade, that is, the front and the back of the outer end of each blade. This differential pressure results in the back-flow of fluid, so that the velocity and quantity of fluid effected at the front fluid-blowing side of the propeller may be reduced.

FIG. 6(*a*) is a plot explaining the pressure distribution at the front and back sides of the conventional propeller and the static pressure curve thereof. As apparent from FIG. 6(*a*), the pressure $P_1$ at the upstream side with respect to the motive zone A of the propeller 1, that is, at the fluid-sucking side B is reduced by the pressure $P_2$ at the just-back of the propeller 1, as the streamline of fluid proceeds in the axial direction indicated by an arrow.

As a result of the increase of the momentum of the propeller 1 due to the rotating force thereof, however, the pressure of fluid is severely increased by the pressure $P_3$ at the just-front of the propeller 1, as compared with the pressure $P_2$ at the just-back of the propeller 1. Thereafter, the pressure of the fluid is gradually, decreased by the pressure $P_4$ at the downstream side, that is, the fluid-blowing side C of the propeller.

Thus, the pressure of the fluid passing through the propeller 1 is discontinuous, in that a differential pressure is generated between the just-front and just-back sides of the propeller 1. Thereby, a back-flow is generated near the outer end of each blade, so that the quantity of the blown fluid is decreased.

SUMMARY OF THE INVENTION

Therefore, an object of the present invention is to provide a propeller construction of an electric fan in which a back-flow of fluid at the outer end of the propeller is prevented, so as to increase the velocity and quantity of the fluid blown from the propeller.

In accordance with the present invention, this object is accomplished by providing a propeller construction of an electric fan comprising several rotatable blades each extending smoothly from a center support portion thereof to form a certain involute angle, said support portion being supported to a shaft of a motor, the construction being characterized in that each of said blades includes an arcuate rib formed at the inside of the peripheral edge of the blade, said rib being outwardly protruded from the front surface of the blade to form a certain angle thereto.

BRIEF DESCRIPTION OF THE DRAWINGS

FIGS. 5(*a*), 5(*b*), and 5(*c*) are enlarged perspective views of ribs formed on the propeller according to the present invention, respectively;

FIGS. 6(*a*) and 6(*b*) are plots for comparing the static pressure in the case of the propeller of the present invention and the static pressure in the case of the conventional propeller;

DETAILED DESCRIPTION OF THE PREFERRED EMBODIMENT

Figure 1:
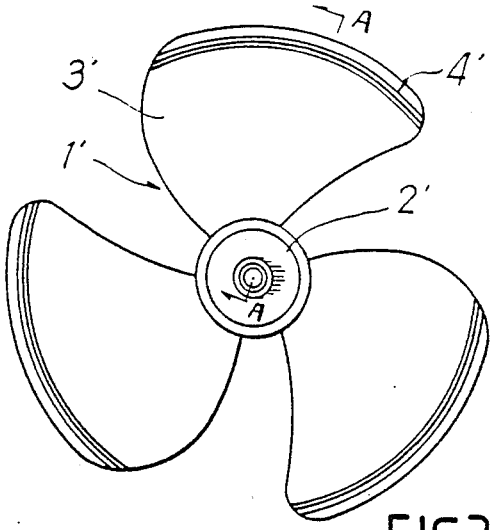
FIG. 1 is a front view of a propeller in accordance with an embodiment of the present invention.
Figure 2:
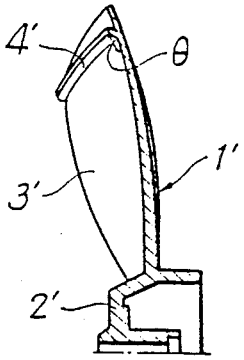
FIG. 2 is a cross-sectional view taken along the line A—A.

Referring to FIGS. 1 and 2, a propeller in accordance with an embodiment of the present invention is shown. The propeller 1' comprises a hub 2' fixedly mounted on a shaft of a motor (not shown) and several rotating blades 3' each extending from said hub 2' and curving at a certain involute angle. From the front surface of each blade 3', that is, the outer peripheral edge of the fluid-blowing side of each blade 3', an arcuate rib 4' with a certain width and certain height (thickness) is formed to be radially spaced with a certain distance from said outer peripheral edge. Each rib 4' is protruded from the curved front surface of the blade 3' to form a certain angle $\theta$ ($\theta$:100° to 160°) therewith.

Figure 3:
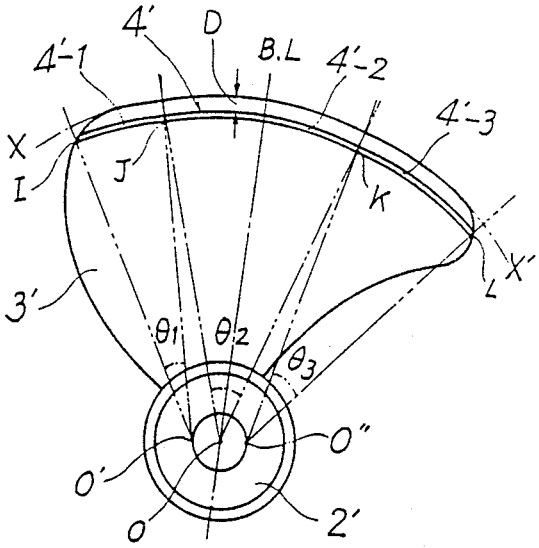
FIG. 3 is a partially-enlarged view explaining the embodiment of the present invention.
Figure 4A:
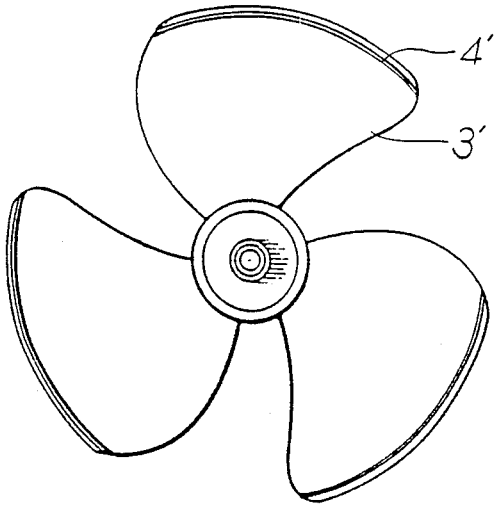
FIGS. 4(*a*) and 4(*b*) are front views of other embodiments of the present invention, respectively.
Figure 4B:
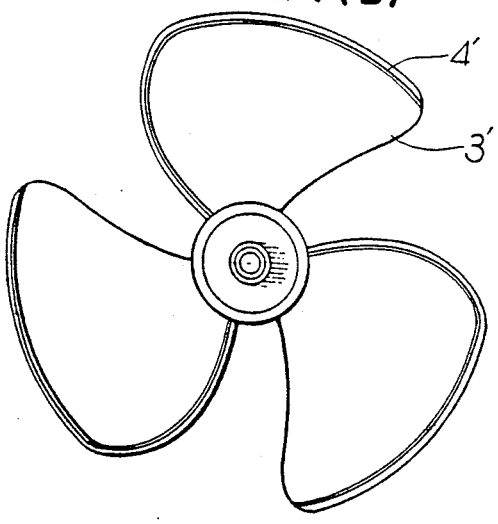

FIG. 3 shows a propeller construction in accordance with a preferred embodiment of the present invention, wherein each rib 4' comprises three rib portions 4'-1, 4'-2, and 4'-3. These rib portions 4'-1, 4'-2, and 4'-3 are integrally formed together and arranged to have a space a line x-x' extending along the outer peripheral edge of the blade 3' by a distance D. In detail, the first rib portion 4'-1 extends from the point I on the one side edge of the blade 3' to the point J which is spaced from said point I to form an angle $\theta_1$ about the point O' shown in FIG. 3 therewith. From the point J, the second rib portion 4'-2 extends to the point K which is spaced from said point J to form an angle $\theta_2$ about the center O of the hub 2' therewith. Points J and K are equally spaced from the basic line BL. The third rib portion 4'-3 extends from the point K to the point L which is disposed on the other side edge of the blade 3' and spaced from said point K to form an angle $\theta_3$ about the point O'' therewith.

Although the above-mentioned embodiment of the present invention includes a single rib 4' formed at the inside of the outer end of each blade 3', one or more ribs may be provided at the inside of the rib 4'.

Referring to FIG. 5, it can be seen that the rib 4' may be variously shaped. The rib 4'*a* shown in FIG. 5(*a*) has a curved portion at the corner of one end thereof. From said one end, the rib 4'*a* smoothly extends, to a certain position, to have a uniform height and then inclinedly extends, to the other end thereof, to have a gradually-decreased height. Thus, the rib 4'a has a streamline shape at each end thereof. The rib 4'b shown in FIG. 5(*b*) has a constant height throughout the length thereof. FIG. 5*c* shows the rib 4'c in which curved portions with a certain curvature are formed at corners of both ends of the rib, respectively. The ribs 4'*a*, 4'*b*, and 4'*c* are preferrably formed to have a height of 1 mm to 6 mm and a thickness of 0.5 mm to 3 mm. It is also preferred that the ribs 4'*a*, 4'*b*, and 4'*c* are formed at the position spaced radially away from the peripheral edge of each blade 3' by the distance D of 30 mm. However, the practical shape and dimensions may be varied, depending upon the shape and the dimension of the propeller.

Although the rib 4' is formed at the position spaced away from the peripheral edge of each blade 3' by a certain distance, it may be directly positioned at the peripheral edge of each blade. Alternatively, the rib may be formed at the peripheral edge and one side portion of each blade.

As apparent from the above description, the propeller 1' of the present invention includes a rib 4' formed on the front surface of the outer end of each rotatable blade 3'. By the provision of the rib 4', it is possible to prevent a backflow of fluid which may be generated at the outer end of each rotatable blade 3' during the rotation of the propeller 1'. Thereby, the velocity and quantity of fluid effected at the front fluid-blowing side of the propeller. Now, the effect of the propeller according to the present invention will be described in detail.

FIG. 6(*b*) shows a plot of the static pressure distribution according to the propeller 1' of the present invention. Referring to FIG. 6(*b*), it can be understood that the difference between the pressure $P'_2$ at the just-back side of the motive zone A' of the propeller 1' and the pressure $P'_3$ at the just-front side of said motive zone A' is greatly decreased, as compared with the difference between the pressure $P_2$ and the pressure $P_3$ in the case of the conventional propeller shown in FIG. 6(*a*).

Figure 7:
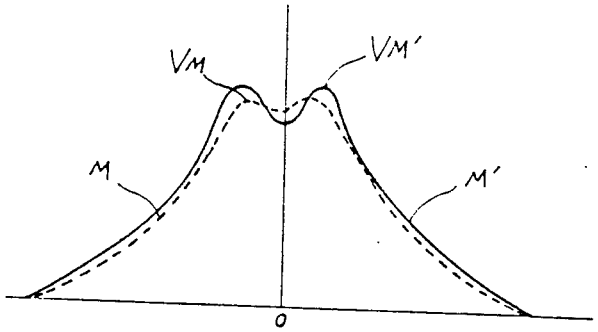
FIG. 7 is a plot for the comparison between the propeller of the present invention and the conventional propeller with regard to the distribution of the velocity of fluid.

FIG. 7 shows the comparison between the propeller of the present invention and the conventional propeller with regard to the distribution of the velocity of fluid. As apparent from FIG. 7, the maximum velocity point VM' in the case of the present propeller is greatly increased, as compared with the maximum velocity point VM in the case of the conventional propeller. As proceeding from the center O'' toward left and right sides in FIG. 7, the width of the flow velocity distribution curve in the case of the present propeller 1' is gradually increased, as compared with that of the flow velocity distribution curve M in the case of the conventional propeller.

Such decrease of the differential pressure and the increase of the width of the flow velocity distribution curve M' and the maximum velocity point VM' result from the increase of the velocity and quantity of the fluid flow, which is caused by the fact that the momentum of the present propeller 1' is increased, as compared with that of the conventional propeller. These results will be apparent from the reference of FIG. 8 which is a view of the comparison of total pressures in the present propeller and the conventional propeller.

Figure 8A:
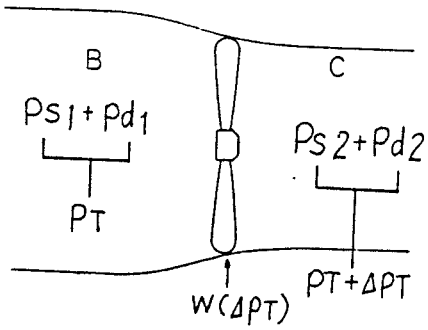
FIGS. 8(*a*) and 8(*b*) are plots for the comparison between the propeller of the present invention and the conventional propeller with regard to the total pressure.
Figure 8B:
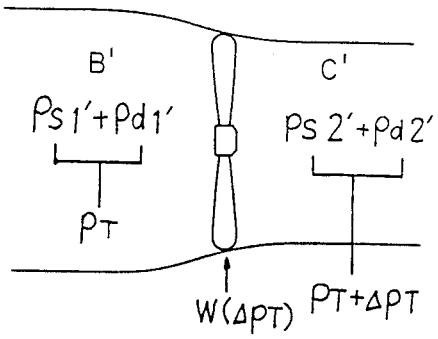

FIG. 8(*a*) shows total pressures at front and back sides of the conventional propeller 1. Referring to FIG. 8(*a*), it can be found that the static pressure $Ps_1$ and the dynamic pressure $Pd_1$ applied to the back side, that is, the fluid-sucking side B of the propeller 1 are composed with the momentum W (ΔPT) generated by the rotation of the propeller 1, and that the resultant pressures are applied to the fluid-blowing side C of the propeller 1. ΔPT is an increment of the total pressure applied to the fluid, that is, air by the rotation of the propeller 1. This increment ΔPT of the total pressure is applied to the static pressure $Ps_2$ and the dynamic pressure $Pd_2$ at the fluid-blowing side of the propeller 1.

However, the momentum W (ΔPT) within the streamline formed by the rotation of the propeller is constant, as apparent from the equation: $\Delta PT = \Delta Ps + \Delta Pd$ (ΔPs: an increment of the static pressure, ΔPd: an increment of the dynamic pressure).

During application of the increment ΔPT of the total pressure to the fluid-blowing side of the present propeller 1', the dynamic pressure $Pd_2$ is effected by said increment ΔPT of the total pressure which is increased in proportion to the difference between static pressures indicated in FIGS. 6(*a*) and 6(*b*). As a result, the static pressure $Ps_2'$ in the case of the present propeller is decreased, as compared with the static pressure $Ps_2$ in the case of the conventional propeller ($Ps_2' < Ps_2$). On the other hand, the dynamic pressure $Pd_2'$ in the case of the present propeller is increased, as compared with the dynamic pressure $Pd_2$ in the case of the conventional propeller ($Pd_2' > Pd_2$). These results correspond to the result that the static pressure in the case of the present propeller is lower than that in the case of the conventional propeller. Consquently, such increase of the dynamic pressure $Pd_2'$ results in the increase of the flow velocity effected at the fluid-blowing side C of the propeller according to the equation: $Pd = rV^2/2g$ (r: specific gravity, v: velocity, and g: gravitational acceleration). thereby, the flow velocity and quantity by the propeller 1' are increased.

Figure 9:
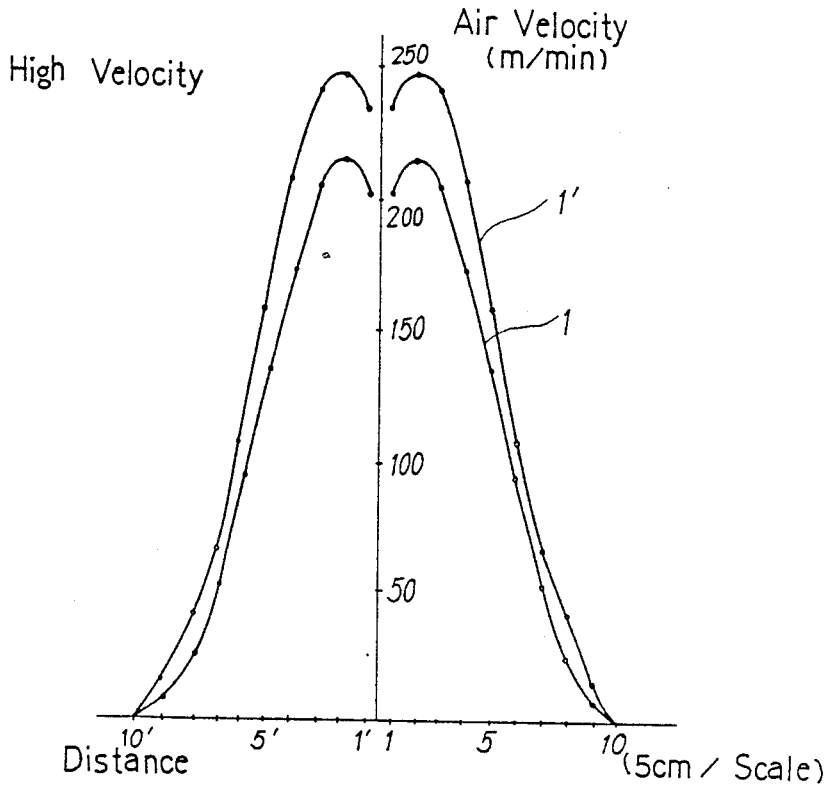
FIGS. 9(*a*), 9(*b*), and 9(*c*) are plots for the comparison between the propeller of the present invention and the conventional propeller with regard to the flow velocity distributions based on various determining distances.
Figure 9B:
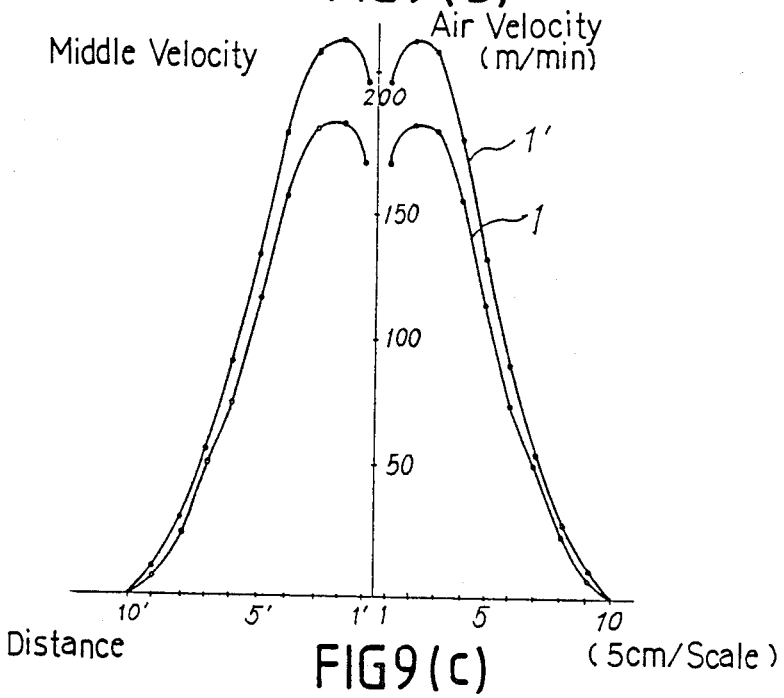
Figure 9C:
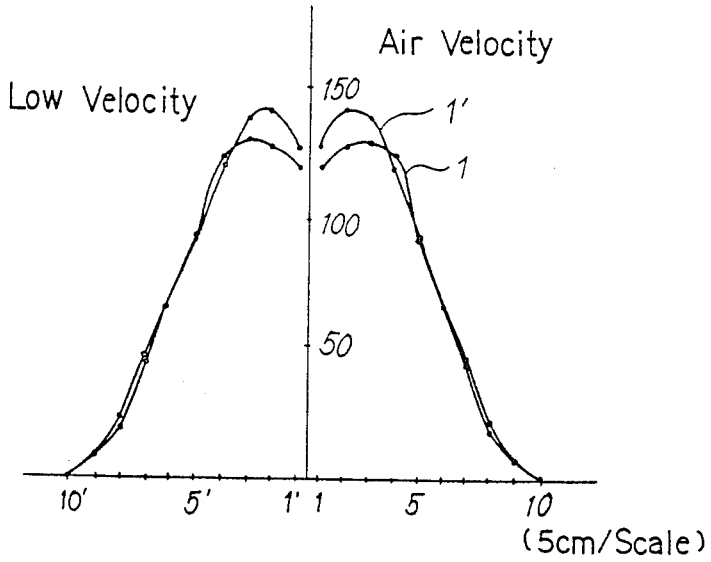
Figure 10:
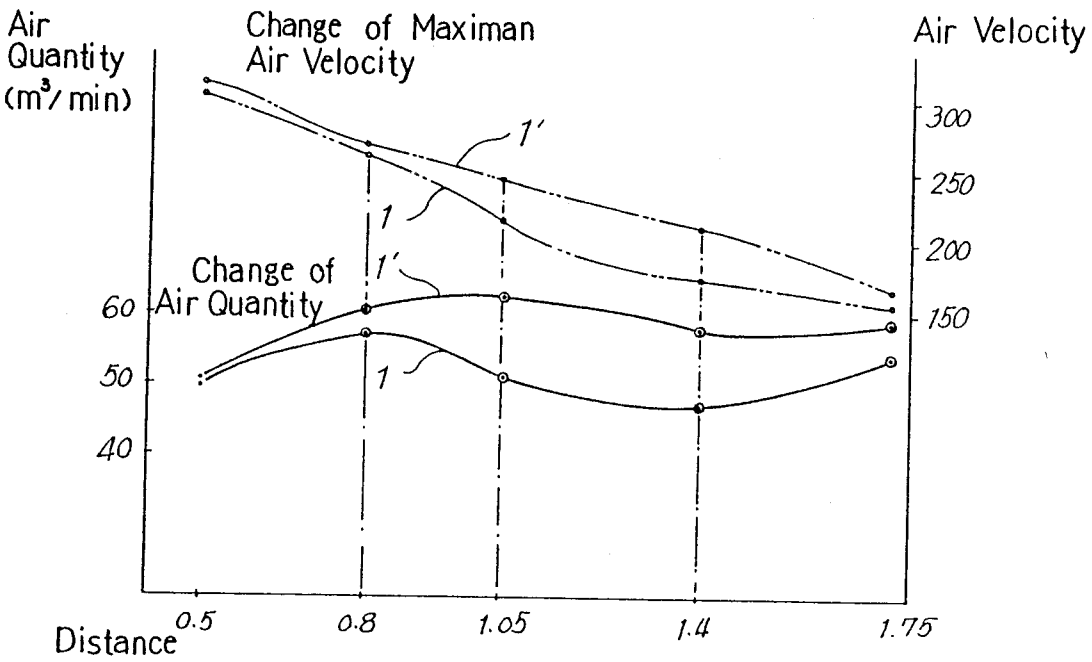
FIG. 10 is a plot for the comparison between the propeller of the present invention and the conventional propeller with regard to the flow velocity and quantity changed depending upon the various determining distance.

The following table shows data for the performance comparison between the conventional propeller and the propeller of the present invention which is the same type as the conventional propeller, but includes a rib 4' formed on each rotatable blade of, for example, FD-367 type manufactured by the assignee of the present application. In detail, the data concerns to the flow velocity, the flow quantity, and the electric efficiency. FIGS. 9(*a*), 9(*b*), and 9(*c*) are plots for the comparison of the flow velocity distributions according to various determining distances and based on the above data. FIG. 10 is a plot for the comparison of the flow velocity and quantity changed depending upon the various determining distance. Referring to the above data and plots, a good performance of the propeller according to the present invention will be apparent.

TABLE

| | | | Comparison for performances FD-367 Blade | | | |
|---|---|---|---|---|---|---|
| | | | case | | | |
| | | | Conventional Propeller | Present Propeller | Change Rate (%) | Reference |
| Performance for V and Q | | | | | | |
| Determining Distance of 1.05 m | High Velocity | Vmax | 215.6 | 248.2 | 15 ↑ | m/min |
| | | Q | 51.2 | 62.74 | | $m^3$/min |
| | Middle Velocity | Vmax | 182.7 | 214.9 | 18 ↑ | |
| | | Q | 45.27 | 52.61 | | |
| | Low Velocity | Vmax | 130 | 141.9 | 9 ↑ | |
| | | Q | 36.65 | 36.42 | 0.6 ↓ | |
| Determining Distance (at High Velocity) | 0.5 m | Vmax | 307.4 | 313.8 | 2 ↑ | |
| | | Q | 49.95 | 50.52 | 1 ↑ | |
| | 0.8 m | Vmax | 263.9 | 270 | 2 ↑ | |
| | | Q | 57.5 | 60.39 | 5 ↑ | |
| | 1.05 m | Vmax | 215.6 | 248.2 | 15 ↑ | |
| | | Q | 51.24 | 62.76 | | |
| | 1.4 m | Vmax | 175.9 | 212.1 | 20 ↑ | |
| | | Q | 47.72 | 58.98 | | |
| | 1.75 m | Vmax | 157.3 | 168.7 | 7 ↑ | |
| | | Q | 54.43 | 59.96 | 10 ↑ | |
| Performance for Electric Power | | | | | | |
| Consumed Electric Power (W) | High Velocity | | 54/59.3 | 53.7/59 | 0 | 110 v/220 v |
| | Middle Velocity | | 47.3/49.1 | 47.2/49 | 0 | |
| | Low Velocity | | 37/40.9 | 36.5/40.9 | 0 | |
| Rotations (rpm) | High Velocity | | 1308 | 1322 | 1 ↑ | |
| | Middle Velocity | | 1117 | 1142 | 2 ↑ | |
| | Low Velocity | | 803 | 832 | 3 ↑ | |
| Electric Power at Start (V) | High Velocity | | 39.5/81.2 | 41/85 | 4/5 | 110 v/220 v |
| | Middle Velocity | | 50/112 | 49.5/113 | −1/1 | |
| | Low Velocity | | 68.3/148 | 70.6/148 | 3/0 | |
| Increase of Temperature | Temperature of Core Wire | | 39.68 | 39.20 | 1 ↓ | Thermal Resistance Method |
| Noise | | | 58.8 | 57.7 | 1.9 ↓ | |

Reference
*the above data is average values for three conventional blades and three present blades.
V: Flow Velocity
Q: Flow Quantity As apparent from the above table and plots, the conventional propeller rotating at high velocity exhibits a maximum velocity Vmax of 215.6 m/min and a flow quantity Q of 51.2 $m^3$/min at the determining distance of 1.05 m, while the present propeller exhibits a maximum velocity of 248.2 m/min and a flow quantity of 62.74 $m^3$/min at the same determining distance. Thus, it can be found that according to the present invention, the maximum velocity and the flow quantity are increased by 15% and 23%, respectively, as compared with the prior art. At the determining distance of 1.4 m, the maximum velocity and the flow quantity are greatly increased by 20% and 24%, respectively.

On the other hand, it can be found that consumed electric powers in both cases are substantially equal. And also, rpm at high, middle, and low velocities are rather increased.

As described hereinbefore, the propeller of the present invention includes an arcuate rib of simple construction formed on the outer end of each rotatable blade to prevent the back-flow of fluid at said outer end of the blade, so that the velocity and quantity of fluid blown from the propeller can be increased, thereby enabling the performance of the electric fan to be improved.

What is claimed is:

1. A fan assembly comprising a propeller fixedly mounted on a shaft having a center line, said propeller having a rear side where fluid enters and a front side where fluid exits, said propeller including a plurality of blades, each of said blades having an arcuate rib located on the front side thereof, each said arcuate rib being made of first, second and third curved portions integrally formed together, said second curved portion being formed as an arc about said center line, said first curved portion being formed as an arc about a first line parallel to said center line and located on one side of said center line, and said third curved portion being formed as an arc about a second line parallel to said center line and located on the opposite side of said center line from said first line.

2. A fan assembly as recited in claim 1, wherein each of said arcuate ribs extends completely across the blade front side upon which it is located.

3. A fan assembly as recited in claim 1, wherein each of said blades has an outer edge and each of said arcuate ribs is positioned at said outer edge.

4. A fan assembly as recited in claim 1, wherein each of said blades has an outer edge and each of said arcuate ribs is positioned less than 30 mm from said outer edge.

* * * * *